United States Patent [19]

Pianta

[11] 4,239,410

[45] Dec. 16, 1980

[54] STATIONERY BOOKLET

[76] Inventor: Mery Pianta, Krähbühlstrasse 135, Zürich, Switzerland

[21] Appl. No.: 9,270

[22] Filed: Feb. 1, 1979

[30] Foreign Application Priority Data

Feb. 10, 1978 [DE] Fed. Rep. of Germany ..... 2805689

[51] Int. Cl.[3] ..... B42F 3/02

[52] U.S. Cl. ..... 402/20; 206/611; 229/92.1; 229/92.3; 281/21 A; 281/1

[58] Field of Search ..... 40/405, 537; 206/610, 206/611; 229/92.1, 92.3; 281/3 R, 3 A, 15 R, 15 A, 15 B, 21 R, 21 A; 402/19, 20

[56] References Cited

U.S. PATENT DOCUMENTS

| | | | |
|---|---|---|---|
| 185,489 | 12/1876 | Buzby | 229/92.1 |
| 268,599 | 12/1882 | Auchincloss | 229/92.3 |
| 2,357,444 | 9/1944 | Armbruster | 229/92.1 |
| 3,124,300 | 3/1964 | Vonderscher | 229/92.1 |

FOREIGN PATENT DOCUMENTS

| | | | |
|---|---|---|---|
| 544691 | 7/1956 | Belgium | 402/20 |
| 1246815 | 10/1960 | France | 402/20 |

*Primary Examiner*—Paul A. Bell

*Attorney, Agent, or Firm*—Weingarten, Maxham & Schurgin

[57] ABSTRACT

The booklet has a refillable binder in which there are writing sheets and opened envelope-forming sheets with a gummed perimeter region bound to the cover by demountable binding rings passing through slots in a stub section. Each sheet and each envelope is separable from the stub section by a perforated tear line. The sheets, as well as the envelopes, are provided with embossed fold lines such that with a sheet lying on an envelope, the folding of the sheet and the folding of the envelope about the sheet can be done simultaneously. Sheet and envelope are torn in assembled form from the binder in a single tearing motion along a perforated line. Another perforated line is provided along one end of the envelope for opening after it is sealed.

Also described is a plastic binding ring which is made up of two identical halves of extruded plastic having interlocking butt joints which snap together.

5 Claims, 3 Drawing Figures

STATIONERY BOOKLET

BACKGROUND OF THE INVENTION

The invention relates to a stationery booklet, or pad, which contains a plurality of stationery sheets. Such a stationery pad is developed further to make possible easier, more problem-free and more sensible handling.

SUMMARY OF THE INVENTION

With the present invention, there can be achieved a very advantageous design of the stationery pad, so that the stationery pad can also have stationery envelopes adjacent the stationery sheets and in such a way that there is achieved an optimum arrangement of the sheets and envelopes. Since the envelopes are in an unfolded form, that is, lying in an open condition, a written sheet can be turned, folded on itself, then have the open envelope folded around it so that it lies within the envelope, and then torn from the pad together with the envelope. It can be seen that in this way there is provided a very convenient, practical handling of the sheet and envelope.

Figure 1:
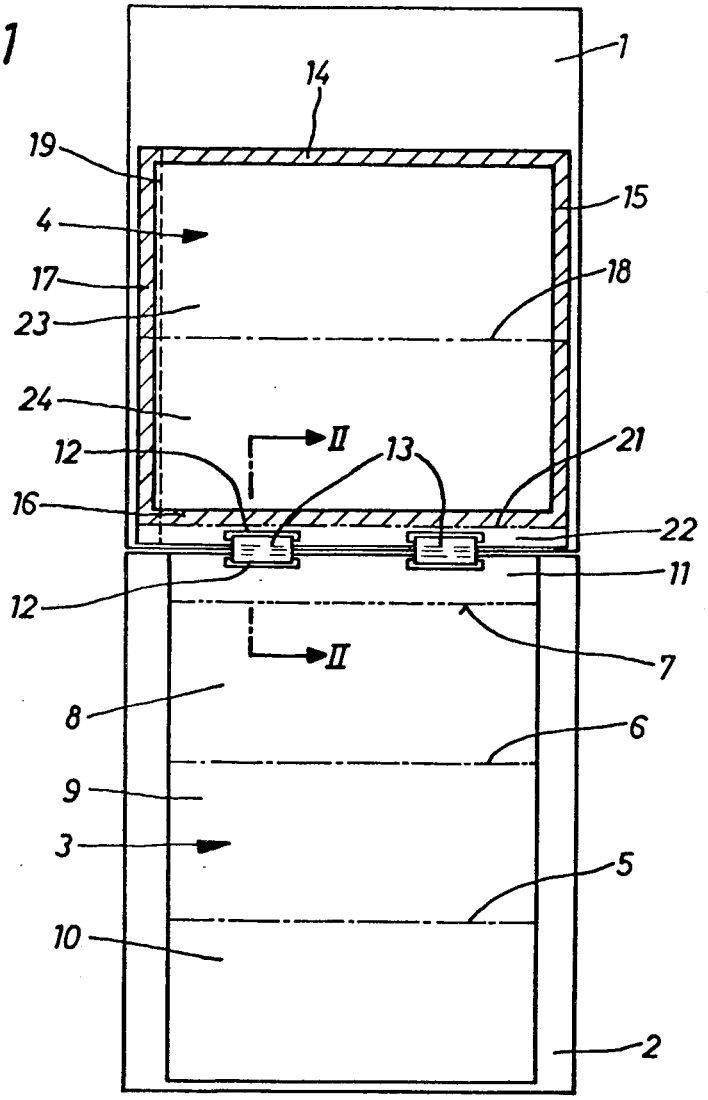
FIG. 1 is a plan view of an opened booklet in accordance with a preferred embodiment of the present invention, with the stationery sheets lying on one side and the envelopes lying on the other.

FIG. *2a* is a view of the open side of a ring-half part of one of the binder rings of the booklet of FIG. 1.

FIG. *2b* is a cross-sectional view of one of the binder ring halves of the binder rings of the booklet of FIG. 1.

DESCRIPTION OF THE PREFERRED EMBODIMENTS

The booklet has two covers 1, 2, which may be of cardboard. There is fastened in the booklet a plurality of stationery sheets 3 and a plurality of envelopes 4. Each sheet 3 is provided with two embossed folding lines 5, 6 as well as with a perforation line 7. Each sheet 3 thereby has three sections 8, 9, 10 to be written on. Attached to this portion of the sheet is a stub 11, which is attached along a perforation line 7. Each stub 11 of the sheets is provided with two slots 12 with which all the sheets are held together by two rings 13 of the binding.

Each envelope 4 lies in an open condition as a page and is provided with an adhesive or gummed portion in the perimeter regions 14–17. These regions which are provided with adhesive are shown as hatched areas in the FIG. 1. Each envelope has a fold-line 18 and two perforation lines 19, 21. The perforation line 19 is shown as a dashed line in FIG. 1, and the perforation line 21 is shown in alternating dots and dashes, similar but different from the fold lines 5,6,18. The perforation lines 7, 21 are shown similar. A stub 22 is separated from the envelope 4 by the perforation line 21. The latter is provided with two slots 12, as was the earlier-mentioned stub 11, through which pass the rings 13 of the binding (ring binding). By means of both rings 13, all the sheets 3 and all the envelopes 4 are held together with their attached stubs 11 and 22, as well as with the two covers 1,2.

When the booklet shown in FIG. 1 is used, it is opened in the manner shown, so that the sheets lie on the one side and the envelopes on the other. Now the sheet 3 can be written on by hand. Should the reverse side also be written on, then the sheet is flipped about the two rings 13 so that it comes to lie on the envelope.

When the letter is finished, the sheet 3 is flipped onto the envelope 4. Now the sheet 3 is folded along the fold line 5. Then the envelope is folded, together with the sheet 3, at the fold line 18 of the envelope and the fold line 6 of the sheet and the regions 15 and 17 pressed together. Now, the envelope with the sheet lying between it is grasped with the hand and torn from the booklet, by which both perforation lines 7 and 21 are torn. Since by this the envelope is not yet closed at the regions 14 and 16, there can still be inserted an enclosure. Now the two border regions 14, 16 of the envelope 4 are pressed together, so that the envelope is sealed, ready for sending. At this time, or even earlier, the envelope can have the address, and possibly also the return address, written on it.

If the envelope is to be opened, then there is torn open the transverse region lying along the perforation line 19, so that the sheet 3 can then be removed.

Figure 2:
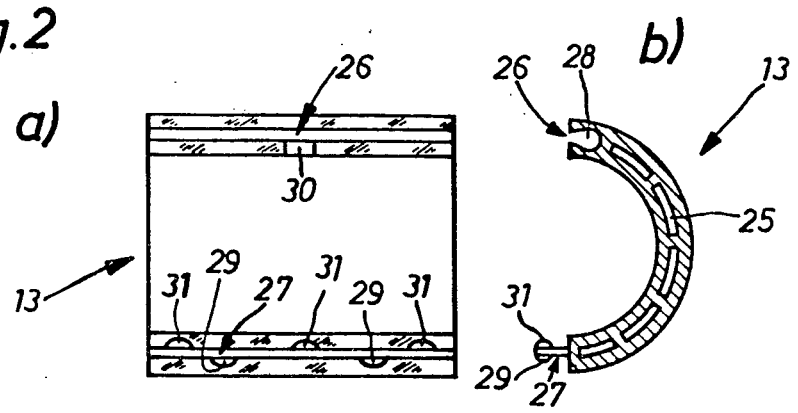

Since the sheets 3 and the envelope 4 lie in the booklet as individual pages which are fastened together solely by the rings 13 of the binding, the booklet can be so designed that the two covers 1, 2 and both rings 13 can be re-used after the sheets and envelopes have been exhausted. One can also then always fasten loose sheets and loose envelopes to the booklet by means of the rings 13. Through such a designing of the booklet, the covers 1, 2 can be designed at greater cost than is usually done, since they can alsways be used again. Through this continuous supplying of sheets and envelopes in the booklet, the sheets, as well as the envelopes, can be printed, e.g. with the address of the sender, so that there is provided a booklet with personalized stationery. In order to achieve this, both rings are designed so that they can be opened. This design of the rings is illustrated in an embodiment in FIGS. 2 and *2b*.

A ring 13 consists of an assembly of two identical ring halves according to FIG. *2b*. Such a ring half is made of extruded plastic which has a hollow inner space 25, a longitudinal groove 26, and longitudinal ribs 27. The longitudinal groove 26 has a widening 28 in its base and the longitudinal rib 27 has bead-like protrusions 29, 31 which fit into the widening 28 of a second ring oriented at 180 degrees to it. The longitudinal rib 27 with the protrusions 29, 31 of one ring thus fit into the longitudinal groove 26 with the widening 28 of the other ring. Both rings can be pressed together radially, by which the longitudinal groove 26 is resiliently expanded by the protrusions 29, 31 until the protrusions 29, 31 lie in the widening 28 and the protrusions of the one ring grip into the longitudinal groove 26 of the other ring, so that thus both rings hold each other in the transverse direction. In order that both rings are also fixed in a longitudinal direction, there is provided an indentation 30 in the longitudinal groove 26. The indentation 30 has the length of the middle one of the protrusions 31. The width of the indentation 30 extends from the inner wall of the ring to the longitudinal groove 26, and the depth of the indentation 30 matches the depth of the longitudinal groove 26 with the widening 28. This indentation 30 represents a transverse widening of the longitudinal groove 26. The middle protrusion 31 of the one ring snaps resiliently into the indentation 30 of the other ring. In this manner, the rings are fixed in the longitudinal direction when pressed together. Only with considerable application of force against the two rings can they be separated again. In this manner, then, the two rings permit the opening and closing of the booklet for binding new sheets and envelopes in the booklet.

In another, not-shown, embodiment of the booklet, the sheets 3 and the envelopes 4 lie alternated, that is, not longer as a group of sheets 3 and a group of envelopes 4.

In another example, instead of the perforation line 19, there can be provided two perforation lines in the envelope 4. The latter then lie at right angles to the perforation line 19, that is, in the same direction as the perforation lines 7, 21, but with one along the region 14 and the other along the region 16. The perforation lines 7,21 are more readily torn by the application of light gripping force than the two alternatively described perforation lines.

I claim:

1. A stationery booklet comprising:

a first cover;

a second cover;

a ring binding hinging said first and second covers together along one adjacent edge of each said cover;

a plurality of stationery sheets independently attached to and individually separable from said booklet along a perforated line lying parallel to the bound edge of said covers, each said sheet being writable on either side and foldable with other stationery sheets without any sheet being detached from said booklet; and a plurality of marginally gummed open envelopes attached to and individually separable from said booklet along a perforated line lying parallel to the bound edge of said covers, each said open envelope being able to receive, to be individually foldable with, and to enclose at least one of said unseparated stationery sheets within the gummed margins to form an envelope with stationery sheets enclosed, prior to said envelope and stationery sheets being detached from said booklet.

2. The booklet according to claim 1, wherein across each sheet there are two embossed folding lines and across each of the envelopes there is one embossed folding line.

3. The booklet according to claim 1, wherein the ring binding has a plurality of transverse-extending rings passing through an opening in the sheets and the envelopes, each ring having two parts which are provided with longitudinal grooves and longitudinal ribs which interlock.

4. The booklet according to claim 3, wherein both parts of the ring are identical, each ring part having a longitudinal groove with a widened base and at the free end a longitudinal rib with bead-like protrusions for interlocking in a transverse direction.

5. The booklet according to claim 3, wherein each longitudinal groove has at least one transverse indentation and each longitudinal rib has at least one bead-like protrusion for resilient deformation of the longitudinal rib in the assembly of the two ring parts to form a ring and having a resiliently interlocking protrusion in an indentation in the assembled ring parts for matching interlocking in the longitudinal ring direction.

* * * * *